US010066882B2

(12) United States Patent
Liu et al.

(10) Patent No.: US 10,066,882 B2
(45) Date of Patent: Sep. 4, 2018

(54) CONNECTING MEMBER AND HEAT EXCHANGER HAVING THE CONNECTING MEMBER

(71) Applicant: Hangzhou Sanhua Research Institute Co., Ltd., Hangzhou, Zhejiang (CN)

(72) Inventors: Ming Liu, Hangzhou (CN); Linjie Huang, Hangzhou (CN); Kai Cui, Hangzhou (CN)

(73) Assignee: Hangzhou Sanhua Research Institute Co., Ltd., Hangzhou, Zhejiang (CN)

( * ) Notice: Subject to any disclaimer, the term of this patent is extended or adjusted under 35 U.S.C. 154(b) by 321 days.

(21) Appl. No.: 14/622,757

(22) Filed: Feb. 13, 2015

(65) Prior Publication Data

US 2015/0241145 A1 Aug. 27, 2015

(30) Foreign Application Priority Data

Feb. 27, 2014 (CN) ..... 2014 1 0068842

(51) Int. Cl.

| | |
|---|---|
| ***F28F 9/02*** | (2006.01) |
| ***F28F 9/26*** | (2006.01) |
| ***F28D 1/053*** | (2006.01) |

(52) U.S. Cl.

CPC ..... *F28F 9/26* (2013.01); *F28D 1/05391* (2013.01); *F28F 9/0224* (2013.01)

(58) Field of Classification Search

CPC ..... F28F 9/26; F28F 9/0224; F28D 1/05391

See application file for complete search history.

(56) References Cited

U.S. PATENT DOCUMENTS

| | | | |
|---|---|---|---|
| 6,397,938 B1 | 6/2002 | Nishishita | |
| 6,449,979 B1 | 9/2002 | Nagasawa et al. | |
| 8,002,024 B2 * | 8/2011 | Higashiyama | F28D 1/05391 165/153 |

(Continued)

FOREIGN PATENT DOCUMENTS

| | | |
|---|---|---|
| CN | 101568792 A | 10/2009 |
| CN | 103033072 A | 4/2013 |

(Continued)

OTHER PUBLICATIONS

EP 2196750 A2 machine translation.*

(Continued)

*Primary Examiner* — Len Tran
*Assistant Examiner* — Gordon Jones
(74) *Attorney, Agent, or Firm* — Wolf, Greenfield & Sacks, P.C.

(57) ABSTRACT

A connecting member includes a first component and a second component fixed to each other, the first component includes a first mounting wall and a first area formed by denting from the first mounting wall, the second component includes a second mounting wall, a second area and a third area, the second mounting wall and the first mounting wall are hermetically fixed, the second area and the third area are both formed by denting from the second mounting wall, and the second area and the third area are arranged with space and are in communication with the first area; the second component further includes a first slot extending through the second area and a second slot extending through the third area, and the first slot and the second slot are provided for communication of the circulating tubes of the heat exchanger.

16 Claims, 11 Drawing Sheets

(56) References Cited

U.S. PATENT DOCUMENTS

| | | | | |
|---|---|---|---|---|
| 8,701,750 | B2 | 4/2014 | Oh et al. | |
| 8,776,873 | B2 * | 7/2014 | Mross | F28D 1/05391 165/173 |
| 9,366,463 | B2 | 6/2016 | Higashiyama et al. | |
| 2002/0000309 | A1 | 1/2002 | Kim et al. | |
| 2006/0162917 | A1 * | 7/2006 | Park | F28F 9/0278 165/175 |
| 2009/0260786 | A1 * | 10/2009 | Palanchon | F28D 9/0031 165/176 |
| 2010/0243223 | A1 | 9/2010 | Lim et al. | |
| 2010/0282454 | A1 | 11/2010 | Jiang et al. | |
| 2011/0220318 | A1 | 9/2011 | Kopchick et al. | |
| 2014/0305158 | A1 | 10/2014 | Kouno et al. | |
| 2015/0053383 | A1 | 2/2015 | Citti et al. | |
| 2015/0241129 | A1 | 8/2015 | Cui et al. | |

FOREIGN PATENT DOCUMENTS

| | | | | |
|---|---|---|---|---|
| CN | 103438750 | A | 12/2013 | |
| DE | 102013203222 | A1 | 8/2014 | |
| EP | 1712868 | A2 | 10/2006 | |
| EP | 2196750 | A2 * | 6/2010 | F25B 39/024 |
| EP | 2372289 | A2 | 10/2011 | |
| FR | 2825793 | A1 | 12/2002 | |
| FR | 2988825 | A1 | 10/2013 | |
| JP | 3395038 | B2 | 4/2003 | |
| JP | 2011074388 | A | 4/2011 | |
| WO | WO 2013/069571 | A1 | 5/2013 | |
| WO | WO 2014/131756 | A1 | 9/2014 | |

OTHER PUBLICATIONS

Extended European Search Report dated Jun. 22, 2015 and the European Search Opinion from corresponding European Application No. 15155074.

Summary of the Chinese 1st Office Action for Application No. CN 201510015522.3 dated Jul. 27, 2016.

Summary of the Chinese 2nd Office Action for Application No. CN 201510015522.3 dated Mar. 1, 2017.

* cited by examiner

CONNECTING MEMBER AND HEAT EXCHANGER HAVING THE CONNECTING MEMBER

This application claims the benefit of priority to Chinese Patent Application No. 201410068842.0 titled "CONNECTING MEMBER AND HEAT EXCHANGER HAVING THE CONNECTING MEMBER", filed with the Chinese State Intellectual Property Office on Feb. 27, 2014, the entire disclosure of which is incorporated herein by reference.

TECHNICAL FIELD

The present application relates to a connecting member and a heat exchanger having the connecting member, and specifically belongs to the field of parallel flow heat exchangers.

BACKGROUND

In recent decades, the refrigeration industry has been developed rapidly, thus a heat exchanger, as one of the four main components of the air conditioner, is also required to be improved to optimize the design according to the market requirements. A parallel flow heat exchanger has characteristics, such as a high cooling efficiency, a small size and a light weight, thus can meet the market requirements quite well, and in recent years, it has been increasingly applied in automotive air conditioning systems and other systems requiring the heat exchanger, such as household appliances.

The parallel flow heat exchanger mainly includes circulating tubes, fins and headers, and the circulating tubes are generally micro-channel flat tubes. The headers are provided at both ends of the micro-channel flat tubes to distribute and collect refrigerant. The corrugated fins or louvered fins are provided between adjacent micro-channel flat tubes to improve the heat exchange efficiency between the heat exchanger and the air. A baffle is provided inside the header to divide all of the micro-channel flat tubes into a plurality of flow paths, and with reasonable distribution of flat tubes in each flow path, a better heat exchange efficiency may be realized.

A circular header is usually employed in the parallel flow heat exchanger to obtain a high pressure resistance. The header of the parallel flow heat exchanger composes of multiple parts and needs multiple manufacturing procedures, such as flanging and welding.

A conventional heat exchanger generally includes an inlet header, an outlet header, fins and flat tubes. The inlet header and the outlet header are arranged in parallel. The flat tubes in the same layer are each formed integrally by bending, and each includes a first horizontal portion connected to the inlet header, a second horizontal portion connected to the outlet header, and a bent portion which is twisted. The first horizontal portion and the second horizontal portion are arranged in parallel.

Referring to U.S. Pat. No. 5,531,268 issued on Jul. 2, 1996, the conventional bent heat exchanger is made on basis of a single-layer heat exchanger, in detail, an arc-shaped surface is formed at the middle of each straight flat tube and then the whole heat exchanger is twisted by a certain degree along a center line of the arc-shaped surface, therefore the single-layer heat exchanger is bent to a double-layer heat exchanger, and after being bent, the arc-shaped surface at the middle of the straight flat tube is the bent portion.

However, such bent portion has the following defects.

Firstly, the bending process of the flat tube has a low precision, which is apt to cause a partial deformation of the heat exchanger and damage structures of the fins nearby, thus the heat exchange efficiency is reduced.

Secondly, the external dimension of the heat exchanger cannot be accurately controlled due to the bending of the flat tube, which in turn results in installation difficulties.

Therefore, it is necessary to improve the conventional technology to solve the above technical problems.

SUMMARY

An object of the present application is to provide a connecting member with an easily controllable precision and a small flow resistance, and a heat exchanger having the connecting member.

For realizing the above object, the following technical solutions are provided according to the present application. A connecting member, configured to cooperate with circulating tubes of a heat exchanger, wherein the connecting member includes a first component and a second component fixed to the first component, the first component includes a first mounting wall and a first area formed by denting from the first mounting wall, the second component includes a second mounting wall, a second area and a third area both formed by denting from the second mounting wall, the second mounting wall and the first mounting wall are hermetically fixed, and a denting direction of the second area and the third area is opposite to a denting direction of the first area, and each of the second area and the third area is arranged with space and are in communication with the first area; the second component further includes a first slot extending through a wall portion configured to form the second area and a second slot extending through a wall portion configured to form the third area, and the first slot and the second slot are respectively provided for insertion of the circulating tubes of the heat exchanger and configured to connect the connecting member to the circulating tubes of the heat exchanger.

For realizing the above object, a heat exchanger is further provided according to the present application, which includes an inlet header, an outlet header, and a plurality of circulating tubes, the plurality of circulating tubes includes a plurality of first circulating tubes in communication with the inlet header and a plurality of second circulating tubes in communication with the outlet header, and the first circulating tubes and the second circulating tubes are arranged in a plurality of layers, wherein the heat exchanger further includes a connecting member installed on sets of the first circulating tube and the second circulating tube, the connecting member is the above-described connecting member; wherein the first circulating tube is inserted into the first slot, the second circulating tube is inserted into the second slot, the inlet header and the outlet header are located at one side of the heat exchanger, and the connecting member is located at the other side of the heat exchanger.

Compared with the conventional technology, in the present application, by additionally providing a connecting member, the manufacturing accuracy of the connecting member is easy to control; and in addition, due to the existence of the second area and the third area, the volume of the connecting member is increased, thereby reducing the flow resistance of the refrigerant.

DETAILED DESCRIPTION

Figure 1:
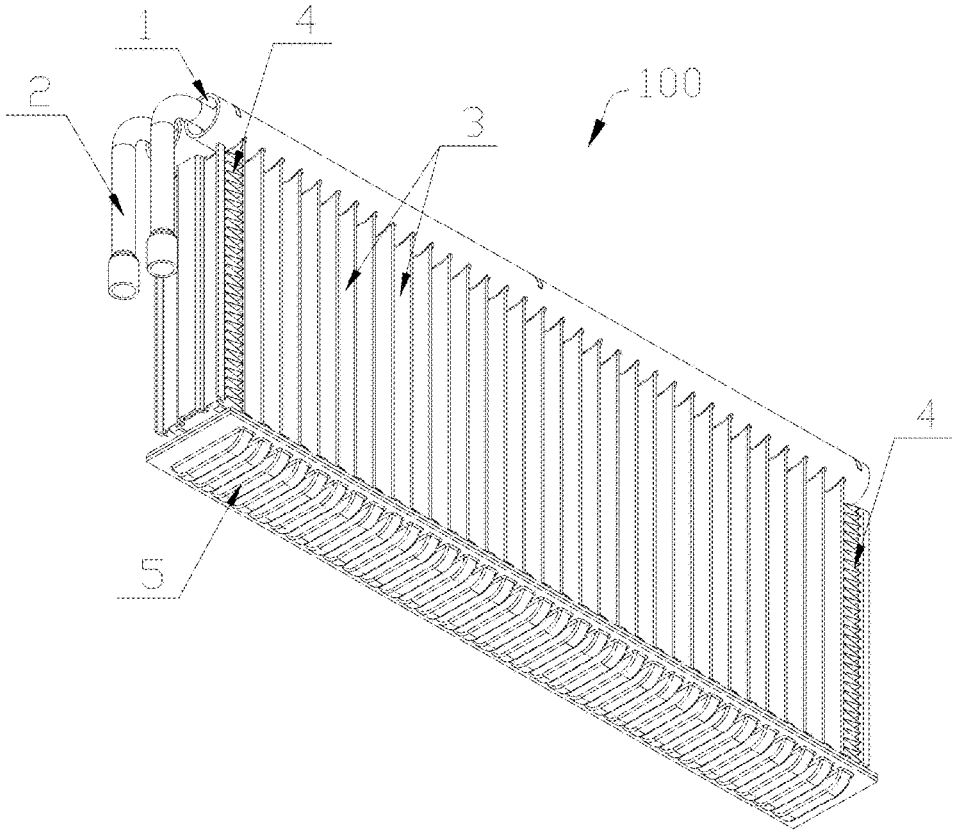
FIG. 1 is a perspective schematic view showing a heat exchanger according to an embodiment of the present application.
Figure 2:
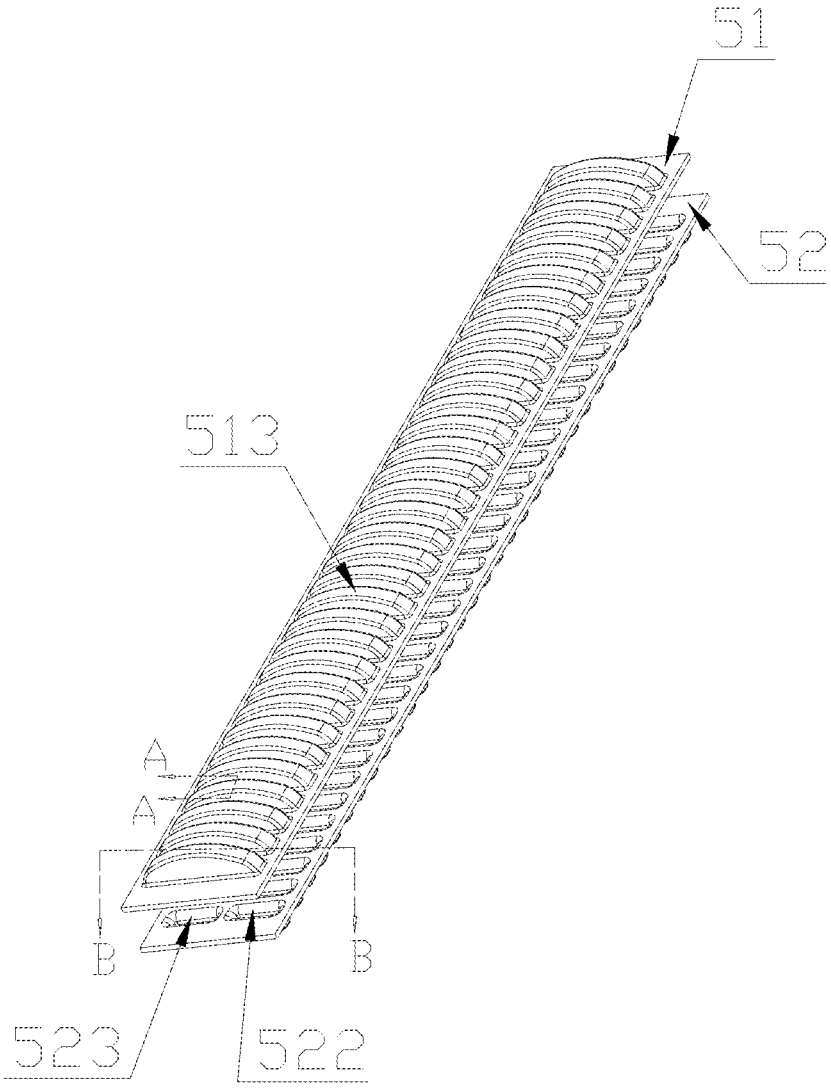
FIG. 2 is a perspective exploded view of a connecting member shown in FIG. 1.
Figure 3:
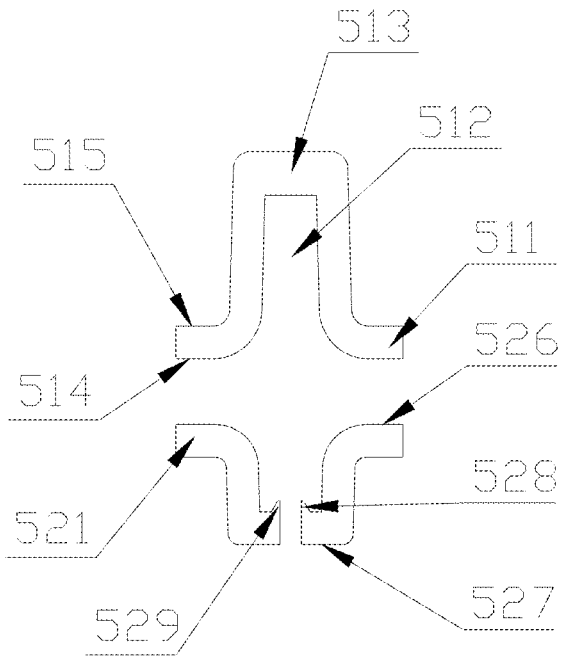
FIG. 3 is a sectional schematic view of the connecting member taken along the line A-A of FIG. 2.
Figure 4:
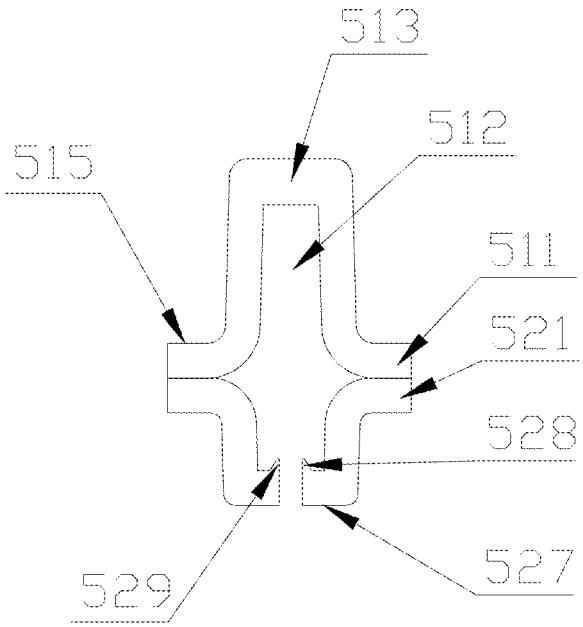
FIG. 4 is a sectional schematic view of the connecting member in FIG. 3 after being assembled.
Figure 5:
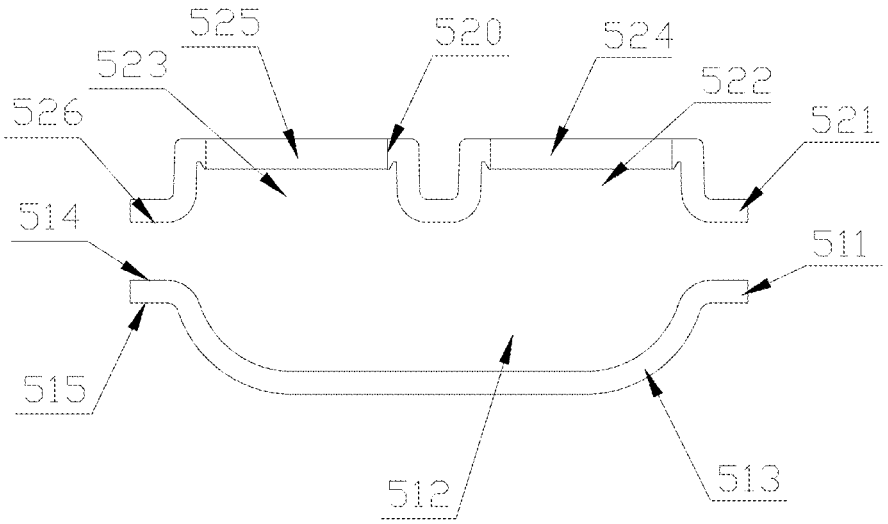
FIG. 5 is a sectional schematic view of the connecting member taken along the line B-B of FIG. 2.
Figure 7:
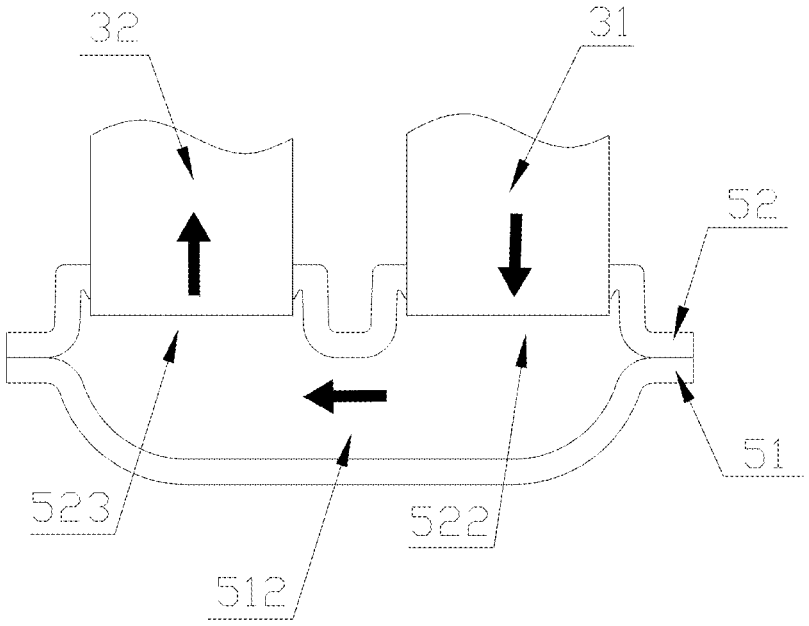
FIG. 7 is a schematic view showing the flowing direction of the refrigerant in the connecting member in FIG. 6 with circulating tubes being inserted in the connecting member.
Figure 8:
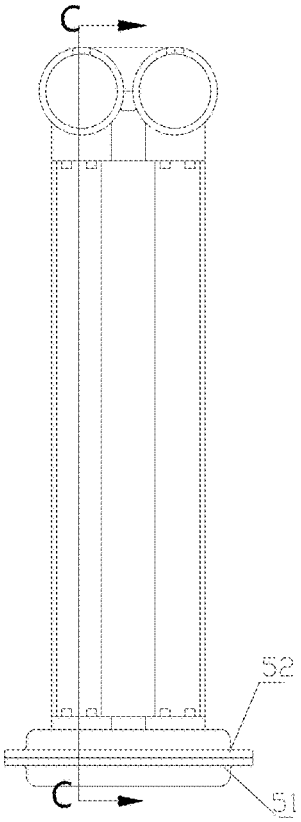
FIG. 8 is a side view of the heat exchanger in FIG. 1.
Figure 9:
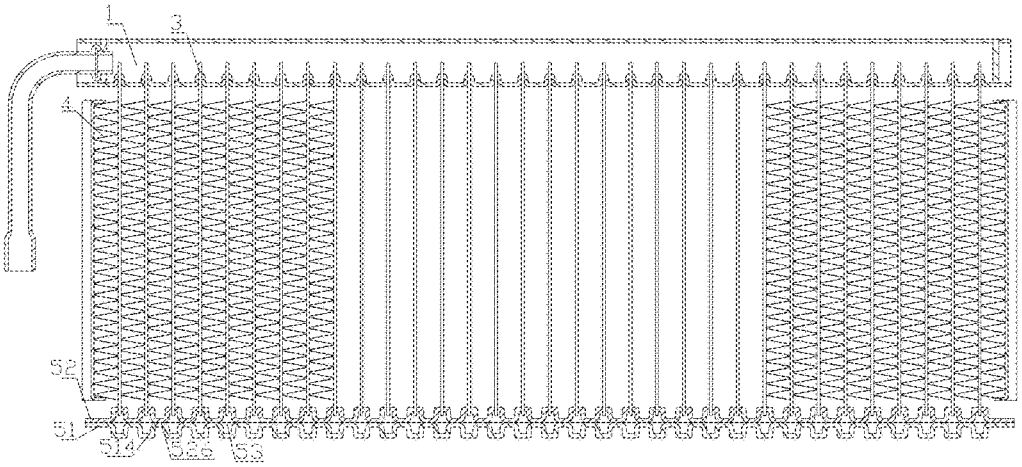
FIG. 9 is a partial sectional schematic view of the heat exchanger taken along the line C-C of FIG. 8, wherein the flat tubes and fins are not cut open.

Reference is made to FIG. 1, a heat exchanger 100 is provided according to the present application, which includes an inlet header 1, an outlet header 2, a plurality of circulating tubes, a plurality of fins 4, and a connecting member 5 being installed on the circulating tubes 3. Reference is made to FIG. 7, the plurality of circulating tubes 3 include a plurality of first circulating tubes 31 each being connected to the inlet header 1 and a plurality of second circulating tubes 32 each being connected to the outlet header 2. The fins 4 are located between two adjacent first circulating tubes 31 as well as between two adjacent second circulating tubes 32. The first circulating tubes 31 and the second circulating tubes 32 are arranged in multiple layers, and the first circulating tube 31 and the second circulating tube 32, which are located in the same layer, are separated and in communication with each other by the connecting member 5.

In an embodiment shown in the figures of the present application, the inlet header 1 and the outlet header 2 are arranged in parallel and both are located at one side of the heat exchanger 100, and the connecting member 5 is located at the other side of the heat exchanger 100. The heat exchanger 100 in the embodiment shown in the figures of the present application is a micro-channel heat exchanger. Correspondingly, the first circulating tubes 31 and the second circulating tubes 32 in this embodiment are both micro-channel flat tubes. In the embodiment shown in the figures of the present application, the inlet header 1 and the outlet header 2 being located at the same side is a basic framework of the heat exchanger 100, and under this basic framework, by arranging the connecting member 5, the structure formed by bending and twisting the same circulating tube in the conventional technology can be avoided. That is, the first circulating tube 31, the second circulating tube 32 and a part of the connecting member 5 are equivalent to a bent and twisted circulating tube in the conventional technology.

It should be noted that, in the embodiment shown in the figures of the present application, the heat exchanger 100 has two layers, and of course, the heat exchanger 100 may have more than two layers in other embodiments, and in this case, the number of the connecting member 5 should be adjusted accordingly.

Reference is made to FIGS. 2 to 7, the connecting member 5 includes a first component 51 and a second component 52 fixed to the first component 51. In the embodiments shown in the figures of the present application, the first component 51 and the second component 52 are both formed by stamping metal material, and the first component 51 and the second component 52 are fixed together by welding, such as by braze welding.

The first component 51 includes a first mounting wall 511, a plurality of first areas 512 formed by denting from the first mounting wall 51 and a plurality of protruding ribs 513 corresponding to the first areas 512, and the protruding ribs are wall structures used for forming the first areas. The first areas 512 and the protruding ribs 513 are both arranged with space and arranged in multiple layers. In the embodiment shown in the figures of the present application, the first component includes a first inner surface and a first outer surface; the first mounting wall 511 is of a rectangular flat plate shape, and includes an inner surface 514 and an outer surface 515, the inner surface 514 is a part of the first inner surface and the outer surface 515 is a part pf the first outer surface. In the embodiment shown in the figures of the present application, the first areas 512 are formed by stamping the first inner surface of the first component. In addition, the protruding ribs 513 are formed simultaneously with the first areas 512 by stamping the first component 51. Each of the protruding ribs 513 protrudes out of the outer surface 515 of the first mounting wall 511 and is substantially arc-shaped or includes an arc shape. The first mounting wall refers to a part of the wall of the first component that is substantially undeformed in the stamping process and is used for cooperating with the mounting wall of the second component.

The second component 52 is closer to the circulating tubes 3 with respect to the first component 51. The second component 52 has a second inner surface and a second outer surface. The second component 52 includes a second mounting wall 521, a plurality of second areas 522, a plurality of third areas 523, a plurality of first slots 524 and a plurality of second slots 525 respectively extending through walls of the second areas 522 and the third areas 523 or extending through the second outer surface. The second mounting wall refers to a part of the wall of the second component that is substantially undeformed in the stamping process and is used for cooperating with the mounting wall of the first component.

Figure 6:
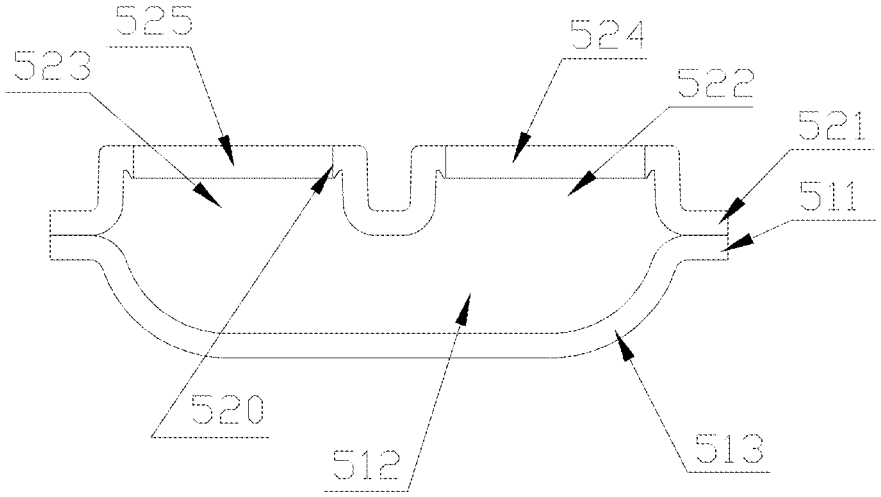
FIG. 6 is a sectional schematic view of the connecting member in FIG. 5 after being assembled.

The second areas 522 are arranged with space and arranged in multiple layers, and the third areas 523 are arranged with space and arranged in multiple layers. The second area 522 and the third area 523, which are in the same layer, are aligned with each other. The second areas 522 and the third areas 523 are both formed by denting from the second mounting wall 521, and the denting direction of the second areas 522 and the third areas 523 is opposite to the denting direction of the first areas 512. The second mounting wall 521 is of a rectangular flat plate shape, and is hermetically fixed to the first mounting wall 511. The second mounting wall 521 includes an inner surface 526 and an outer surface 527, the second areas 522 and the third areas 523 dent from the inner surface 526, and the first slots 524 and the second slots 525 extend through the wall of the second component. Reference is made to FIGS. 6 and 7, the first slot 524 and the second slot 525 are used for respectively cooperating with the first circulating tube 31 and the second circulating pipe 32 of the heat exchanger 100, and the first circulating tube 31 and the second circulating pipe 32 are respectively inserted into the first slot 524 and the second slot 525 and are connected to a clamping plane 520. In addition, reference is made to FIGS. 3 and 4, the second component 52 may also include a first protrusion 528 which protrudes into the second area 522 and is located at a periphery of the first slot 524, and a second protrusion 529 which protrudes into the third area 523 and is located at a periphery of the second slot 525. In the embodiment shown in the figures of the present application, the first protrusion 528 and the second protrusion 529 are formed by stamping the second component. The first protrusion 528 is used to cooperatively engage with the corresponding first circulating tube 31, to increase a length of the cooperative connection between the first slot 524 and the first circulating tube 31, and the second protrusion 529 is used to cooperatively engage with the corresponding second circulating tube 32, to increase a length of the cooperative connection between the second slot 525 and the second circulating tube 32. Specifically, referring to FIGS. 5 and 6, the first protrusion 528 and the second protrusion 529 are both provided with a clamping plane 520 for cooperating with the corresponding circulating tube. Due to such arrangement, on one hand, the first circulating tube 31 and the second circulating tube 32 may be better pre-positioned when being inserted into the first slot 524 and the second slot 525, and on the other hand, a larger welding area may be provided in welding.

The first component 51 and the second component 52 are fixed by welding, the first circulating tube 31 and the second circulating tube 32 are also fixed to the second component 52 by welding, and the inner surface 514 of the first mounting wall and the inner surface 526 of the second mounting wall are abutting with each other and are fixed by welding. The second area 522 and the third area 523 are in communication with the first area 521 at the same layer to form a cavity 53, thereby forming a transition passage, multiple cavities 53 formed at the multiple layers are relatively independent from each other, and transition passages at different layers are insulated from each other, to ensure the flow order of the refrigerant in the connecting member 5 and avoid disorder. Thus the first circulating tube 31 and the second circulating tube 32 are in communication with each other through the cavity 53 formed by the first area 521, the second area 522 and the third area 523, thereby avoiding the problem of unequal distribution which may possibly occur during a secondary distribution.

During the operation of the heat exchanger 100, the refrigerant enters into the inlet header 1, then enters into the first circulating tube 31, and then enters into the connecting member 5, and then flows out of the connecting member 5 to enter into the second circulating tube 32, and finally enters into the outlet header 2. Specifically, the flow path of the refrigerant in the connecting member 5 is described as follows. Firstly, the refrigerant enters into the second area 522 of the connecting member 5, then enters into the first area 512 of the connecting member 5, and then enters into the third area 523 of the connecting member 5. Due to the existence of the second area 522 and the third area 523, the volume of the connecting member 5 is increased, thereby reducing the flow resistance of the refrigerant. Besides, in order to improve the structural strength, one side of the protruding rib 513 that faces the first slot 524 and the second slot 525 is of an arc shape or two sides of the protruding rib 513 are both of an arc shape, such design may also function to guide the refrigerant, thereby further reducing the flow resistance. The shape and depth of the protruding rib 513 may be flexibly designed according to requirements.

In assembling process, the inner surface 526 of the second mounting wall 521 and the inner surface 514 of the first mounting wall 511 are abutting with each other tightly and are fixed by braze welding, to isolate transition passages at different layers from each other to form multiple independent cavities 53, thereby ensuring that the refrigerant can only flow out of the second circulating tube 32 at the same layer after entering into the connecting member 5 from the first circulating tube 31.

Compared with a heat exchanger formed by bending, the number of the circulating tubes in the present application is doubled, and each circulating tube has a length less than a half of the original length, and the connecting member 5 is used to replace the bent and twisted portion. Since the accuracy of the connecting member 5 is controllable, the heat exchanger 100 of the present application has a high overall machining precision, and deformation of fins which is caused by the bending and twisting of the circulating tubes may be avoided, thereby ensuring a better heat exchange efficiency and an artistic appearance of the heat exchanger 100. Besides, the size of the heat exchanger 100 of the present application may be accurately controlled, which facilitates the installation. Moreover, by installing the connecting member 5 on the circulating tubes, the bending of the circulating tubes is avoided, thereby reducing the overall processing difficulty of the heat exchanger. Besides, due to the existence of the second area 522 and the third area 523, the volume of the connecting member 5 is increased, thereby reducing the flow resistance of the refrigerant.

Figure 10:
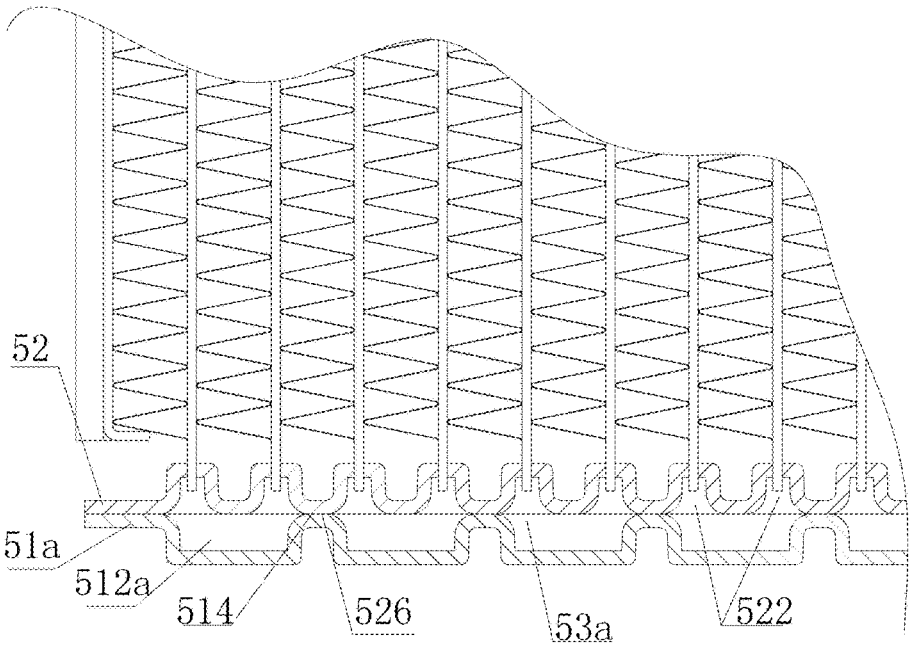
FIG. 10 is a partial sectional schematic view of a heat exchanger according to another embodiment.

In above embodiments, each set of the second area 522 and the third area 523 is correspondingly provided with one first area, thus the first circulating tube at each layer communicates with the second circulating tube in the same layer. Besides, as shown in FIG. 10, adjacent two sets or three sets of the second areas 522 and the third areas 523 are in communication with the first area 512*a*, that is, the first area 512*a* of the first component 51*a* communicates with adjacent two sets or three sets of the second areas 522 and the third areas 523 simultaneously, which forms a relatively independent cavity 53*a* to communicate circulating tubes at this portion with each other. In this way, the refrigerant enters into the cavity 53*a* from the first circulating tube 31 in communication with the relatively independent cavity 53*a*, and then flows from the cavity 53*a* to the second circulating tube 32 in communication with the cavity 53*a*. That is, the first component is provided with multiple first areas, the second component is provided with multiple second areas and multiple third areas, the first areas are arranged in multiple layers, and the second areas and the third areas are also arranged in multiple layers, and the number of layers of the sets of the second areas and the third areas is an integral multiple (n) of the number of layers of the first areas, wherein the second areas and the third areas disposed in adjacent n layers are in communication with the corresponding first area to form a cavity, thereby forming a transition passage, and transition passages of different cavities are isolated from each other; wherein $1<n<4$.

Figure 11:
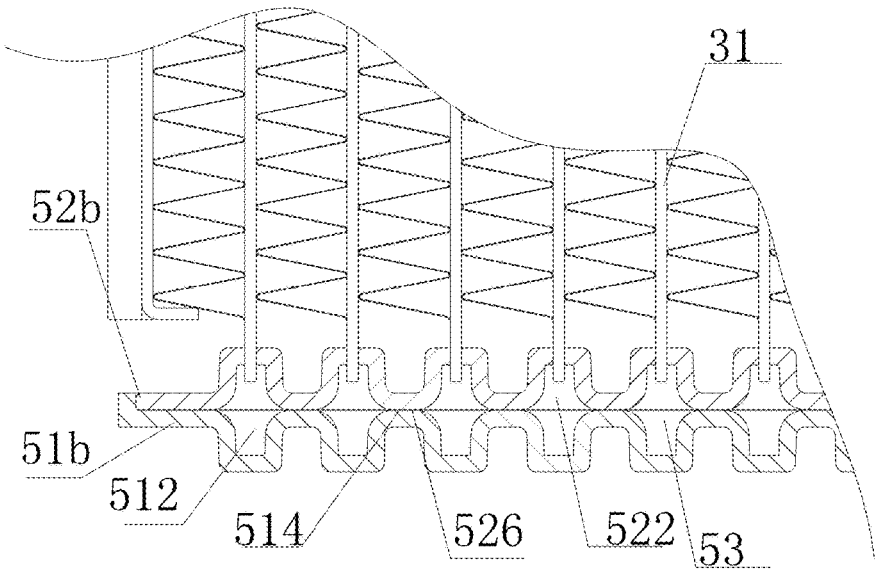
FIG. 11 is a partial sectional schematic view of a heat exchanger according to yet another embodiment.
Figure 12:
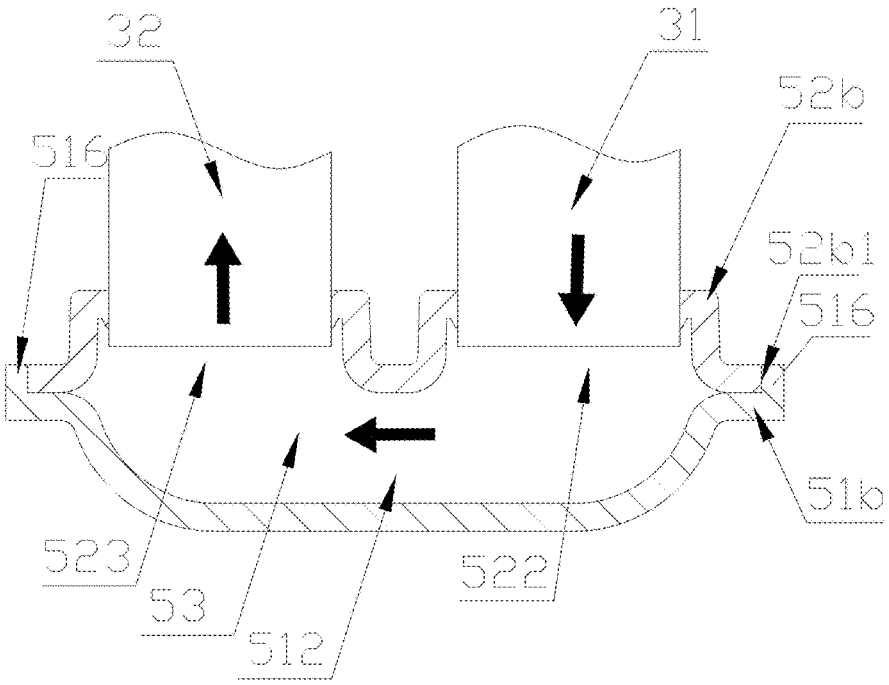
FIG. 12 is a sectional schematic view showing a set of circulating tubes and a transition passage of the heat exchanger in FIG. 11.

In addition, in order to make the connection between the first component and the second component more reliable, one of the first component and the second component may employ a flanging structure, as shown in FIGS. 11 and 12. A reinforcing structure 516 is provided at a periphery of a first component 51*b*, and the reinforcing structure 516 of the first component 51*b* has an inner end surface fixed to an outer end surface 52*b*1 of a second component 52*b*. Between the first component 51*b* and the second component 52*b*, not only the inner surface 526 of the second mounting wall 521 and the inner surface 514 of the first mounting wall 511 are abutting with each other tightly and fixed by braze welding, the inner end surface of the reinforcing structure 516 of the first component 51*b* and the outer end surface 52*b*1 of the second component 52*b* are also fixed by braze welding, thus the welding strength is good and the connection of the two components are more reliable.

It should be noted that, the above embodiments are only intended for describing the present application, and should not be interpreted as limitation to the technical solutions of the present application. Although the present application is described in detail in conjunction with the above embodiments, it should be understood by the person skilled in the art that, combinations, modifications or equivalent substitutions may still be made to the present application by the person skilled in the art; and any technical solutions and improvements thereof without departing from the spirit and scope of the present application also fall into the scope of the present application defined by the claims.

The invention claimed is:

1. A connecting member, configured to cooperate with circulating tubes of a heat exchanger, wherein the connecting member comprises a first component and a second component fixed to the first component, the first component comprises a first mounting wall and a first area denting from the first mounting wall, the second component comprises a second mounting wall, a second area and a third area both denting from the second mounting wall, the second mounting wall and the first mounting wall are hermetically fixed, and a denting direction of the second area and the third area is opposite to a denting direction of the first area, and each of the second area and the third area is arranged with space and are in communication with the first area; the second component further comprises a first slot extending through a first wall portion configured to form the second area and a second slot extending through a second wall portion configured to form the third area, and the first slot and the second slot are respectively provided for insertion of the circulating tubes of the heat exchanger and configured to connect the connecting member to the circulating tubes of the heat exchanger; and wherein the second component comprises a first protrusion which protrudes into the second area and is located at a periphery of the first slot, the second component comprises a second protrusion which protrudes into the third area and is located at a periphery of the second slot, and the first protrusion and the second protrusion are both provided with a clamping plane configured to cooperatively engage with corresponding circulating tubes, to increase a length of the cooperative connection between the first slot and a first circulating tube and between the second slot and a second circulating tube;

wherein a thickness in the vertical direction of the clamping plane is larger than a thickness of the second mounting wall;

a third protrusion denting from an inner surface of the second component is located between the second area and the third area, and the third protrusion protrudes in a direction close to the first mounting wall; and the first component is provided with a protruding rib corresponding to the first area, and the protruding rib protrudes out of the outer surface of the first mounting wall and has a straight top end in a sectional view taken along a length direction of the first component.

2. The connecting member according to claim 1, wherein the first component is provided with a plurality of the first areas along a longitudinal direction of the connecting member, the second component is provided with a plurality of the second areas and a plurality of the third areas both arranged along the longitudinal direction of the connecting member, the first areas are arranged in a plurality of layers, and the second areas and the third areas are also arranged in a plurality of layers, wherein the second area and the third area are both in communication with the first area at the same layer to form a cavity which forms a transition passage.

3. The connecting member according to claim 2, wherein the number of layers of each of the first areas and the third areas is same as the number of layers of the first areas, and the transition passages in different layers are isolated from each other; the first mounting wall and the second mounting wall are both of a flat plate shape, and are abutting with each other to isolate the transition passages in different layers from each other.

4. The connecting member according to claim 3, wherein the first area dents from an inner surface of the first mounting wall and protrudes out of an outer surface of the first mounting wall; the second area and the third area both dent with respect to an inner surface of the second mounting wall, and the first slot and the second slot extend outward though a second outer surface.

5. The connecting member according to claim 4, wherein the inner surface of the first mounting wall abuts against the inner surface of the second mounting wall, in such a way the engaged mounting walls isolate the transition passages in different layers from each other.

6. The connecting member according to claim 5, wherein the first component comprises a first outer surface and a first inner surface, the second component comprises a second inner surface and the second outer surface, the first component and the second component are both made of metallic material, and the first inner surface and the second inner surface are abutting with each other and fixed together.

7. The connecting member according to claim 4, wherein the first component comprises a first outer surface and a first inner surface, the second component comprises a second inner surface and the second outer surface, and the first area is formed by stamping outwardly the first inner surface of the first component.

8. The connecting member according to claim 1, wherein an outer surface of the protruding rib is of an approximately arc shape or comprises an arc-shaped structure.

9. The connecting member according to claim 1, wherein the first component is provided with a plurality of the first areas, the second component is provided with a plurality of the second areas and a plurality of the third areas, the first areas are arranged in a plurality of layers, the second areas and the third areas are also arranged in a plurality of layers, and the number of layers of each of the second areas and the third areas is an integral multiple (n) of the number of layers of the first areas, wherein the first area and adjacent n layers of the second areas and the third areas are in communication with each other to form a cavity which forms a transition passage, and the transition passages of different cavities are isolated from each other; wherein $1<n<4$.

10. The connecting member according to claim 9, wherein the first component comprises a first outer surface and a first inner surface, the second component comprises a second inner surface and a second outer surface, and the first slot and the second slot extend outward though the second outer surface; wherein the first area dents from an inner surface of the first mounting wall and protrudes out of an outer surface of the first mounting wall; the second area and the third area dent from an inner surface of the second mounting wall, and the inner surface of the first mounting wall and the inner surface of the second mounting wall are abutting with each other and fixed together, to isolate the transition passages in different layers from each other.

11. The connecting member according to claim 1, wherein one of the first component and the second component is provided with a reinforcing structure with a flanging portion, and an inner end of the reinforcing structure of one of the first component and the second component and an outer end of the other of the first component and the second component are abutting with each other and fixed together.

12. A heat exchanger, comprising an inlet header, an outlet header, and a plurality of circulating tubes, the plurality of circulating tubes comprising a plurality of first circulating tubes in communication with the inlet header and a plurality of second circulating tubes in communication with the outlet header, and the first circulating tubes and the second circulating tubes being arranged in a plurality of layers, wherein the heat exchanger further comprises a connecting member installed on sets of the first circulating tubes and the second circulating tubes, and wherein the connecting member is the connecting member according to claim 1.

13. The heat exchanger according to claim 12, wherein the first component is provided with a plurality of the first areas, the second component is provided with a plurality of the second areas and a plurality of the third areas, the first areas are arranged in a plurality of layers, and the second areas and the third areas are also arranged in a plurality of layers, wherein the second area and the third area are in communication with the first area at the same layer to form a cavity which forms a transition passage.

14. The heat exchanger according to claim 13, wherein the number of layers of each of the first areas and the third areas is the same as the number of layers of the first areas, and transition passages in different layers are isolated from each other; the first mounting wall and the second mounting wall are both of a flat plate shape, and are abutting with each other to isolate the transition passages in different layers from each other.

15. The heat exchanger according to claim 12, wherein the first component is provided with a plurality of the first areas, the second component is provided with a plurality of the second areas and a plurality of the third areas, the first areas are arranged in a plurality of layers, the second areas and the third areas are also arranged in a plurality of layers, and the number of layers of each of the second areas and the third areas is an integral multiple (n) of the number of layers of the first areas, wherein adjacent n layers of the second areas and the third areas are in communication with the first area to form a cavity which forms a transition passage, and the transition passages of different cavities are isolated from each other; wherein $1<n<4$.

16. The heat exchanger according to claim 15, wherein the first component comprises a first outer surface and a first inner surface, the first area dents from an inner surface of the first mounting wall and protrudes out of an outer surface of the first mounting wall; the second component comprises a second inner surface and a second outer surface, the second area and the third area dent from an inner surface of the second mounting wall, and the first slot and the second slot extend outward though the second outer surface; and the inner surface of the first mounting wall and the inner surface of the second mounting wall are abutting with each other and fixed together, to isolate the transition passages in different layers from each other.

* * * * *